US005930922A

United States Patent [19]

Altheide

[11] Patent Number: 5,930,922

[45] Date of Patent: Aug. 3, 1999

[54] VEHICLE MOUNTED SNOWPLOW

[76] Inventor: Charles Edward Altheide, P.O. Box 78, Bloomfield, Iowa 52537

[21] Appl. No.: 08/819,706

[22] Filed: Mar. 12, 1997

[51] Int. Cl.[6] ..... E01H 5/06

[52] U.S. Cl. ..... 37/268; 37/231; 37/232; 37/236; 172/684.5; 296/100

[58] Field of Search ..... 37/268, 281, 231, 37/232, 269, 274, 234, 235, 236, 219; 172/272, 684.5; 296/100, 161, 24.1, 108, 103, 183, 96.13, 152; 224/42.2

[56] References Cited

U.S. PATENT DOCUMENTS

| | | | |
|---|---|---|---|
| 3,800,447 | 4/1974 | Harvey | 37/268 X |
| 4,145,825 | 3/1979 | Bertolino | 37/281 X |
| 4,284,218 | 8/1981 | Gillis et al. | 224/42.06 |
| 5,014,961 | 5/1991 | Ferguson | 37/231 X |
| 5,046,271 | 9/1991 | Daniels | 37/268 X |
| 5,058,295 | 10/1991 | Holland | 37/268 |
| 5,183,307 | 2/1993 | Chiu, Jr. | 296/24.1 |
| 5,265,355 | 11/1993 | Daniels | 37/268 R |
| 5,285,588 | 2/1994 | Niemela et al. | 37/232 X |
| 5,392,538 | 2/1995 | Geerligs et al. | 37/268 |
| 5,647,153 | 7/1997 | Gervais | 37/231 |

FOREIGN PATENT DOCUMENTS

| | | | |
|---|---|---|---|
| 245009 | 6/1947 | Switzerland | 37/268 |

OTHER PUBLICATIONS

Sidewing Snowplows web site, pp. 1 & 2, Jan. 1997.
Snowman Snowplow web site, pp. 1 & 2, Aug. 1997.
Toyota Truck & 4Runner 1988 Repair Manual, p. FU–29, Jan. 1988.
B & B Truck Equipment, Inc. brochure, Byron Center, MI, date unknown.
Daniels Pull Plow Brochure, No Date.

*Primary Examiner*—Thomas B. Will
*Assistant Examiner*—Victor Batson
*Attorney, Agent, or Firm*—Zarley, McKee, Thomte, Voorhees & Sease

[57] ABSTRACT

The snowplow of the present invention is adapted to mount to the bed of a pickup truck. The snowplow includes a mounting base and a frame which is rotatably coupled to the base. The snowplow blade is coupled to the frame so that it moves with the frame. By attaching a prime mover to the frame and base, the blade can be raised and lowered over a very wide range. The frame and blade are adjustable so that the same snowplow can be used on trucks with differing heights or with lift kits.

21 Claims, 9 Drawing Sheets

VEHICLE MOUNTED SNOWPLOW

BACKGROUND OF THE INVENTION

1. Field of the Invention

The present invention relates to snowplows. More particularly, though not exclusively, the present invention relates to an apparatus and method for mounting a snowplow to a truck.

2. Problems in the Art

Typical prior art snowplows for use with pickup trucks attach to the front or rear of the pickup truck. A typical front mounted snow plow attaches to the front bumper of a pickup truck or to the front of the frame of the truck. With a front mounted snowplow, snow is pushed by driving into the snow with the blade of the snowplow lowered toward the ground.

A typical rear mounted plow or pull plow, is mounted to the receiving hitch or bumper of the pickup truck. A typical pickup truck will have a two inch receiver-type hitch positioned below the bumper of the pickup truck. A typical prior art pull plow can be secured to the receiver-type hitch by inserting an arm into the receiver hitch of the truck. The typical pull plow includes a flat box scraper which is movable up and down by the use of a hydraulic cylinder. One major disadvantage of a prior art pull plow is that the box scraper has a maximum clearance of only about twelve inches. This prevents the pull plow from being used effectively on large snow drifts or for snow piled against a wall or garage.

Another disadvantage of a typical prior art pull plow is that because of the varying heights of pickup trucks or the use of lift kits with pickup trucks, the same pull plow will not work with every truck since the height of the receiver hitch will vary with the height of the truck. Another disadvantage with a prior art pull plow is that the plow can be damaged if the plow gets caught on a solid object such as a large rock, a tree stump, an extending piece of cement, etc.

Therefore, it can be seen that there is a need for an improved rear mounted snowplow that is simple, efficient, and works with a variety of trucks.

FEATURES OF THE INVENTION

A general feature of the present invention is the provision of a method and apparatus for providing a snowplow which overcomes problems found in the prior art.

A further feature of the present invention is the provision of a method and apparatus for providing a snowplow which is mounted to the bed of a truck.

A further feature of the present invention is the provision of a method and apparatus for providing a snowplow which can be raised to a height significantly greater than the prior art.

Further features, objects and advantages of the present invention include:

A method and apparatus for providing a snowplow which can be bolted to the bed of the pickup truck without any welding.

A method and apparatus for providing a snowplow which includes an adjustment for compensating for the varying heights of pickup trucks.

A method and apparatus for providing a snowplow which includes a spring loaded trip action for protecting the snowplow.

A method and apparatus for providing a snowplow having a blade with a substantially higher reach for use with high snow drifts.

A method and apparatus for providing a snowplow which is powered by a hydraulic cylinder.

A method and apparatus for providing a snowplow which can be easily removed from the truck when not in use.

A method and apparatus for providing a snowplow which includes a storage stand for use when the snowplow is not mounted to the truck.

A method and apparatus for providing a snowplow which includes a cover to protect the power unit while mounted on the pickup truck.

These as well as other features, objects and advantages of the present invention will become apparent from the following specification and claims.

SUMMARY OF THE INVENTION

The snowplow of the present invention is comprised of a base which mounts to the bed of a truck. The movable frame is attached to the base as well as to a blade. A prime mover is also coupled to the frame such that by activating the prime mover, the blade is moved between a first position near the ground to a second position away from the ground. The present invention may optionally include a means for adjusting the height of the blade relative to the base so that the same snowplow can be used on a variety of sizes of trucks. The present invention may also optionally include a trip action so that the plow is not damaged by solid objects in the ground.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
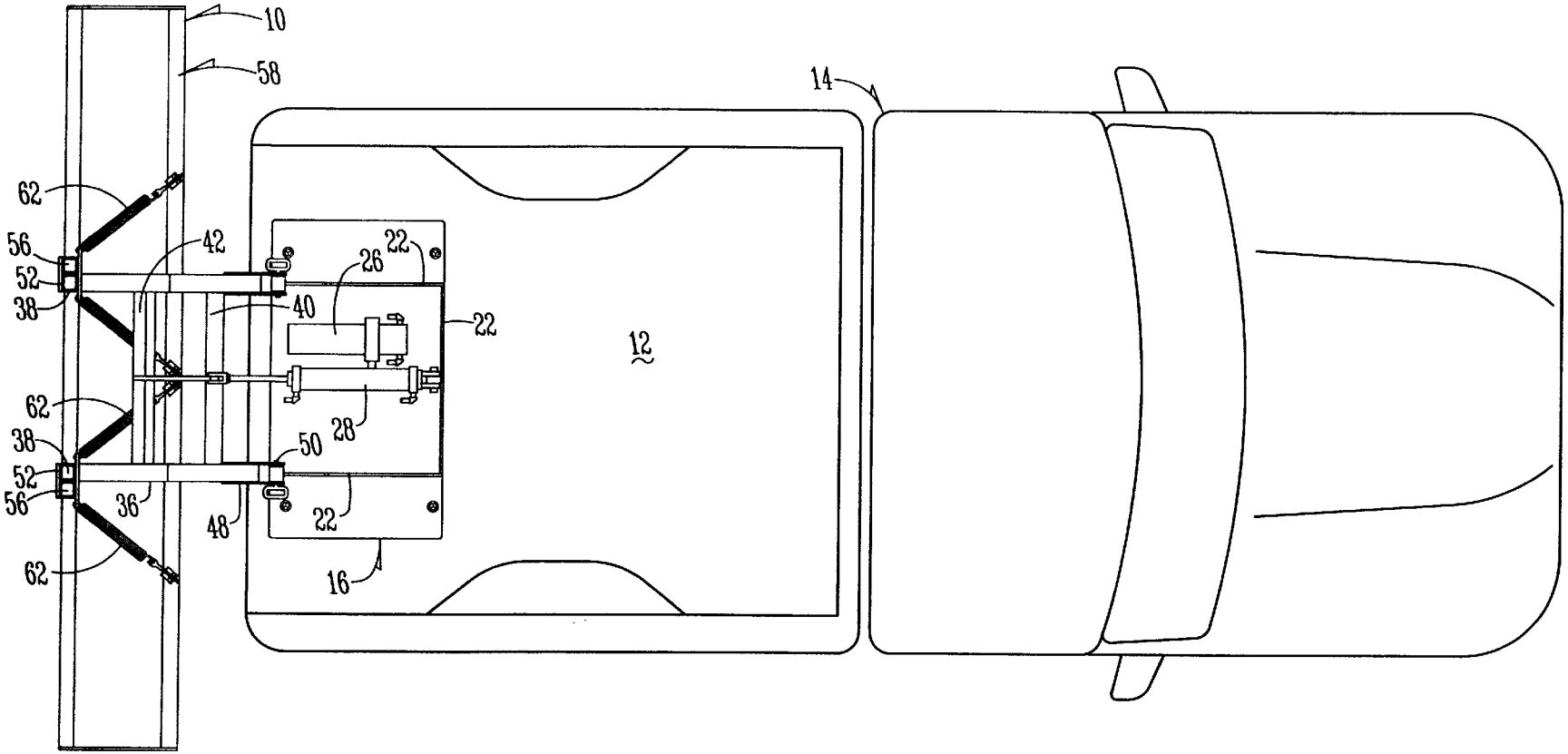
FIG. 1 is a top view of the snowplow of the present invention mounted to a pickup truck.

FIG. 1 is a top view of a snowplow 10 of the present invention mounted to the bed 12 of a pickup truck 14. FIG.

Figure 3:
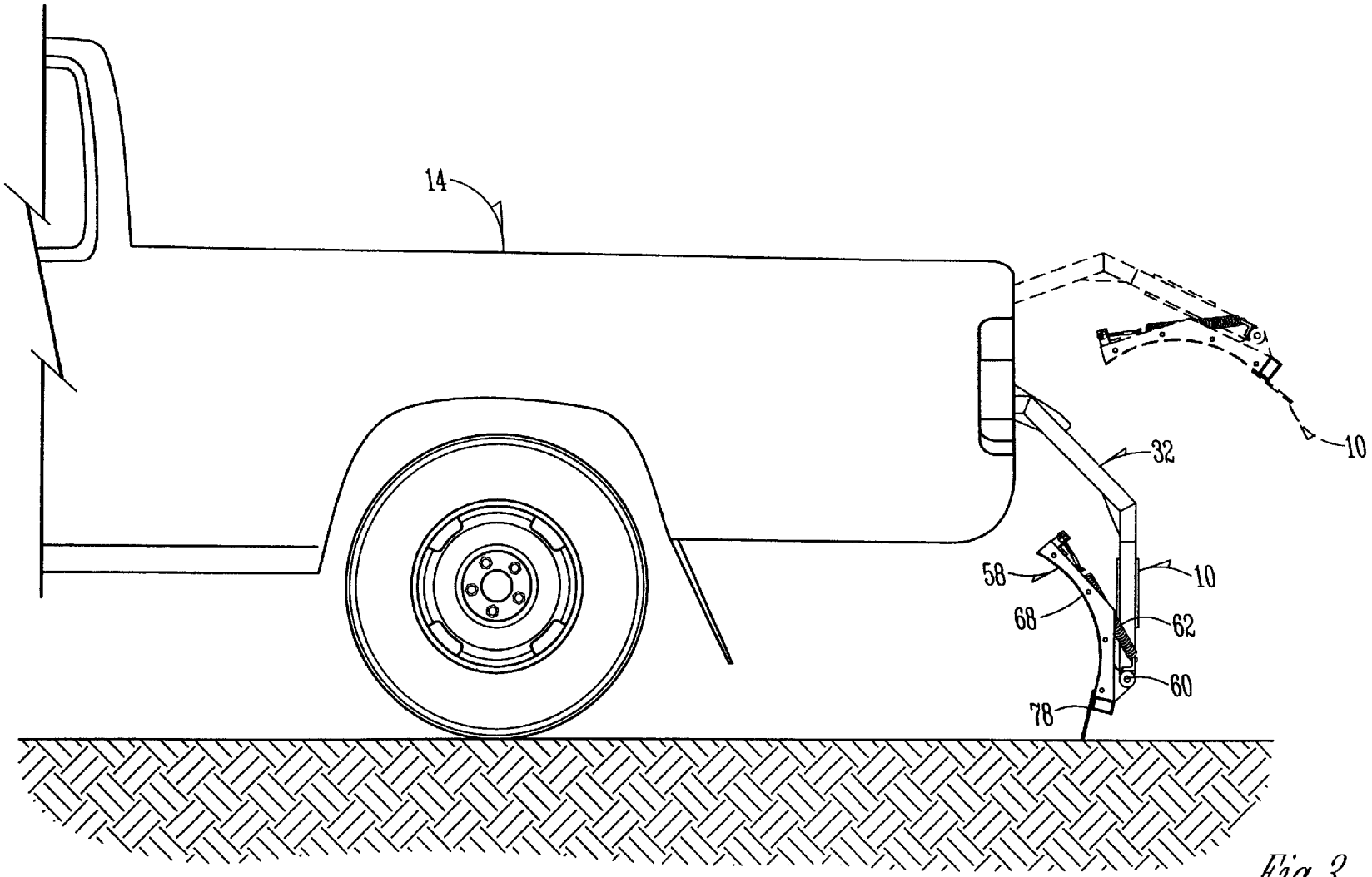
FIG. 3 is a side view of a pickup truck showing the snowplow of the present invention in raised (dashed lines) and lowered (solid lines) positions.
Figure 4:
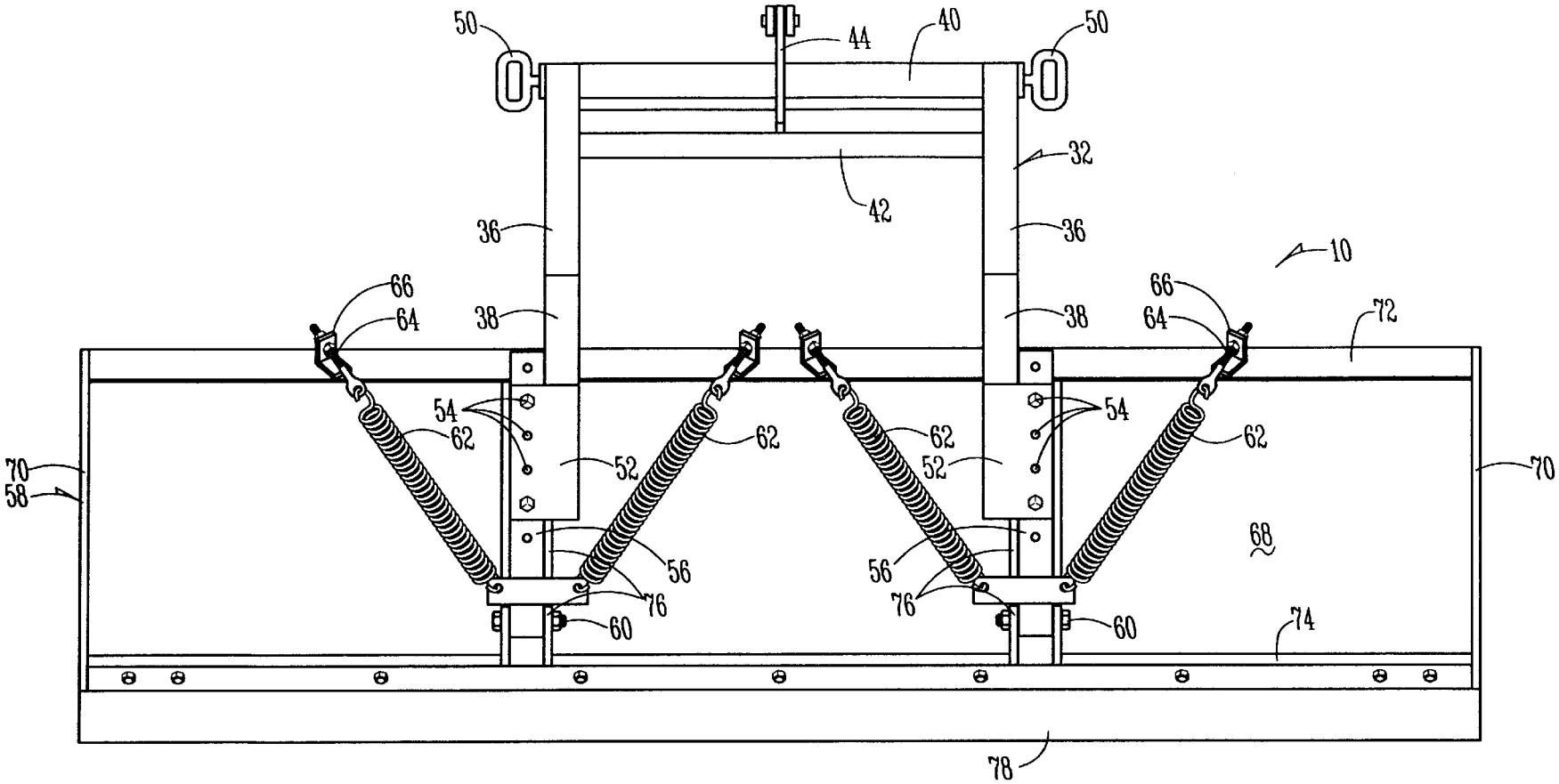
FIG. 4 is a rear view of the snowplow of the present invention.
Figure 5:
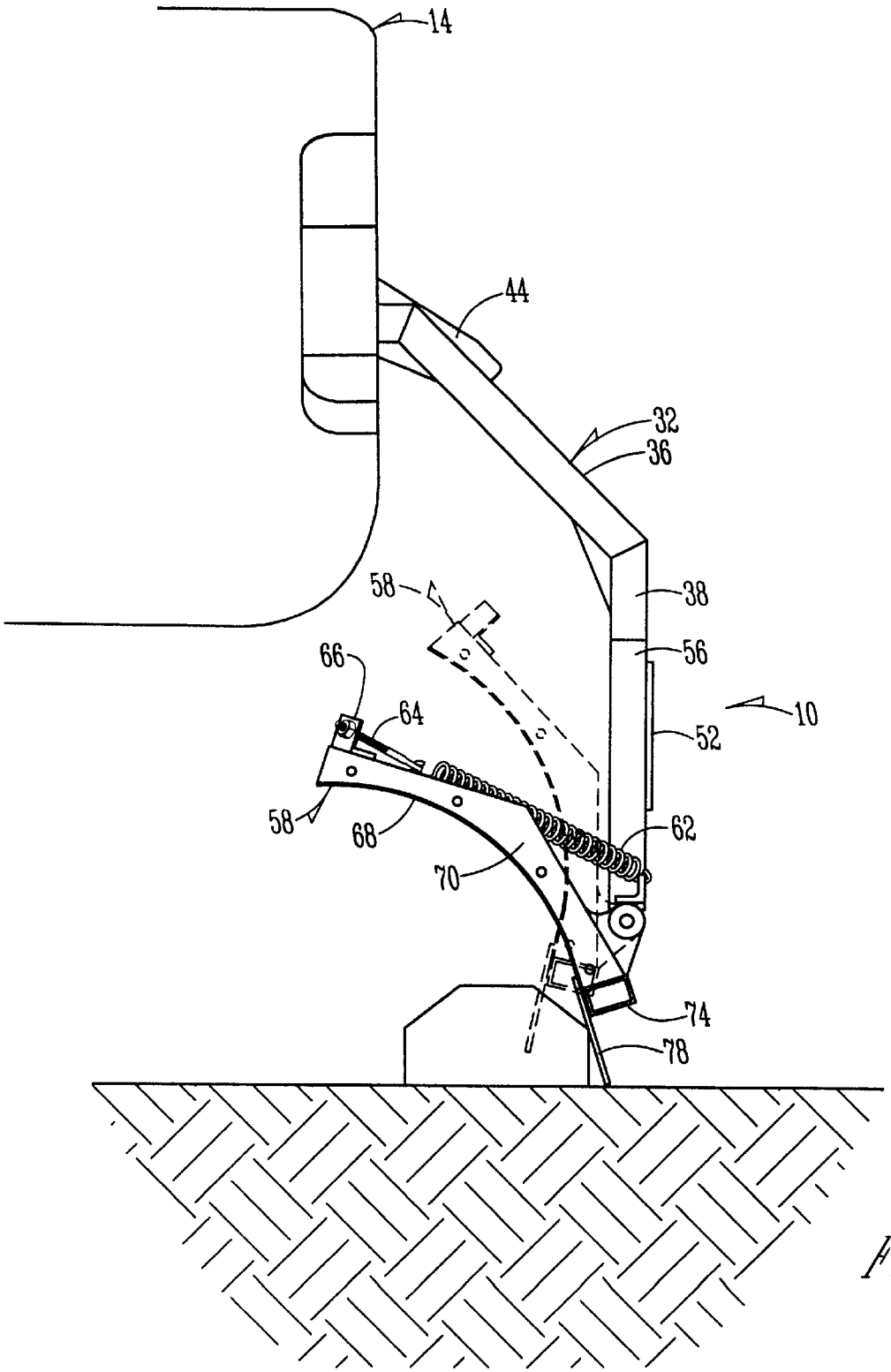
FIG. 5 is a side view of the snowplow of the present invention showing the trip action of the blade of the snow plow.

2 is an enlarged top view of the snowplow 10 shown in FIG. 1. FIG. 3 shows a side plan view of the snowplow 10 in a lowered (solid lines) and raised (dashed lines) positions. FIG. 4 is a rear view of the snowplow 10 in the lowered position. FIG. 5 shows a side view of the trip action of lowered (solid lines) and raised (dashed lines) positions. FIGS. 6–11 show various alternative embodiments of the present invention.

Figure 2:
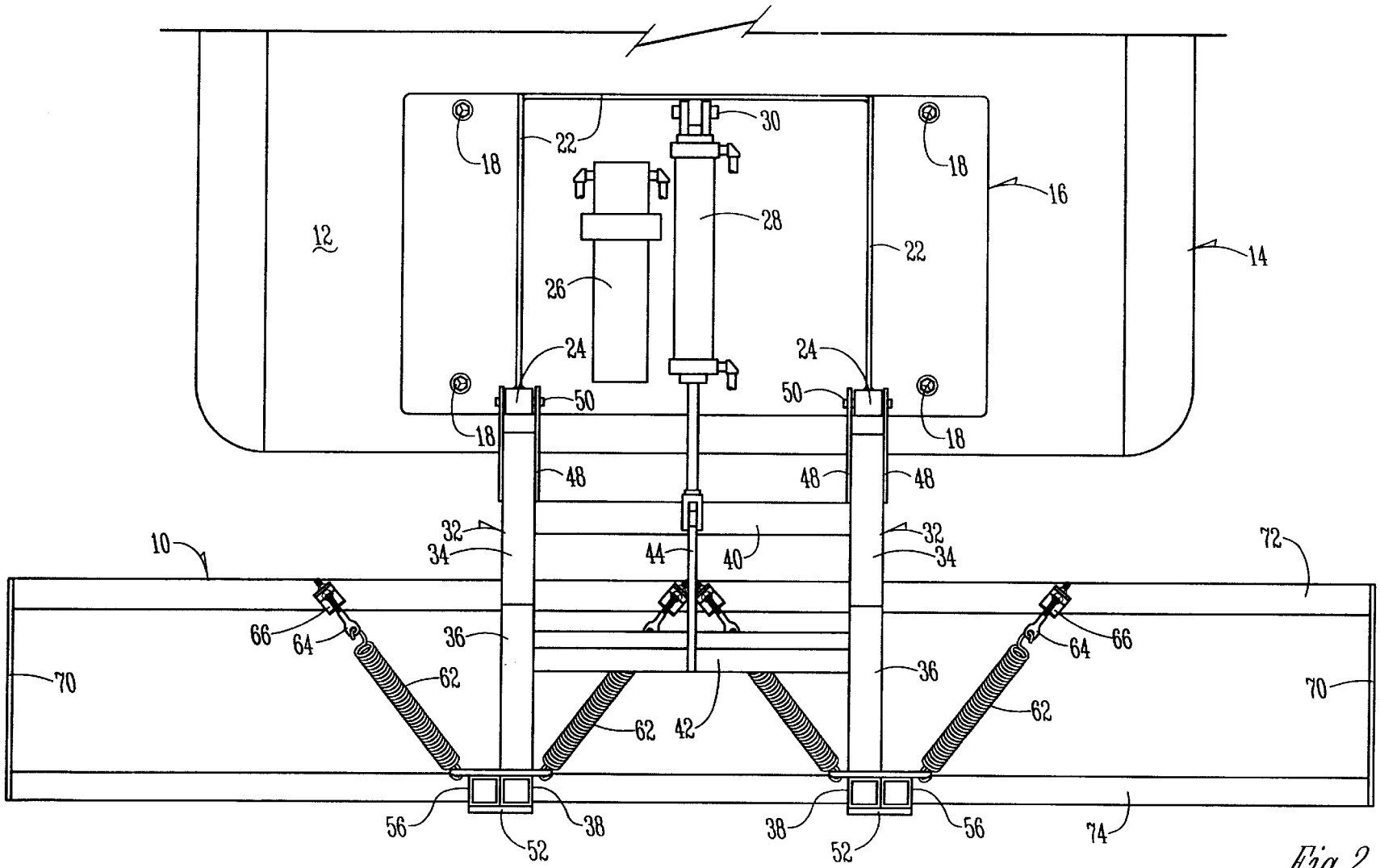
FIG. 2 is an enlarged top view of the snowplow of the present invention.

FIGS. 1 and 2 shows a conventional pickup truck 14 having a flat horizontal bed 12 with the tailgate removed. As shown, the snowplow 10 of the present invention is mounted to the rear portion of the bed 12 of the pickup 14. The snowplow 10 includes a mounting plate 16 which is generally rectangular in shape. The mounting plate 16 is rigidly secured to the bed 12 of the pickup truck 14 by four bolts 18 which extend through the mounting plate 16 and the bed 12 and are secured to the side of the frame (not shown) of the pickup truck 14 via four L-shaped brackets (not shown) which are bolted to the frame of the pickup 14. Alternatively, the mounting plate 16 can be welded to the bed 12 or the frame. Located between the mounting plate 16 and the bed 12 is an anti-scuff mounting plate pad (not shown) comprised of a rectangular sheet of rubber or the like which serves to protect the bed 12 of the pickup truck 14 from scratches, etc.

Welded vertically to the mounting plate 16 are three reinforcing strips 22 which are comprised of quarter inch steel and are approximately four inches high. At the rear of the mounting plate 16, secured to the mounting plate 16 and two of the strips 22, is a pair of horizontally positioned journals 24 which create a pivot point for the snowplow 10 (discussed below). Also welded to the mounting plate 16 are the appropriate mounting brackets (not shown) for mounting a prime mover, such as the hydraulic power unit 26 and the hydraulic cylinder 28, to the mounting plate 16. The hydraulic power unit 26 is rigidly mounted to the mounting plate 16 while the hydraulic cylinder 28 is rotatable about pin 30. With the snowplow mounted to the mounting plate 16 in this configuration, activating the hydraulic cylinder 28 will move the snowplow 10 between a lowered position (shown in solid lines in FIG. 3) and a raised position (shown by dashed lines in FIG. 3). The preferred embodiment of the present invention uses a 12 volt MTE Hydraulic Power Unit Part No. S202T*3739 and a Cross Hydraulic Cylinder Part No. 022743 212DB. The preferred embodiment provides approximately 750 lbs. of downward pressure.

The snowplow 10 includes a frame 32 which is comprised of two parallel arms each comprised of upper, middle, and lower arm segments 34, 36, and 38, respectively. This is shown best in FIG. 10 which shows the frame 32 disconnected from the mounting plate 16. The upper, middle, and lower arms 34, 36, and 38 are welded together at angles as shown. Optionally, gussets 39 can be welded at the joints to strengthen the frame. The gussets 39 on each arm can be replaced by a single long gusset which spans the length of the middle arm segment 36. The remainder of the frame can also include similar gussets at each joint if an increased strength is desired. The frame 32 includes an upper lateral arm 40 and a lower lateral arm 42 (FIG. 2). The upper lateral arm 40 is welded to each of the upper arm segments 34 near the center of the upper arm segments 34. The lower lateral arm 42 is welded to each middle arm segment 36 at a position near the joint of the upper arm segment 34 and the middle arm segment 36. Welded to the upper and lower lateral arms 40 and 42 is a cylinder bracket 44 which includes a hole 46 near the upper lateral arm 40 for rotatably connecting the hydraulic cylinder 28 to the frame 32. In this way, when the hydraulic cylinder 28 is activated, the cylinder will apply pressure to the cylinder bracket 44 which will then rotate the frame 32 about the pivot point created by the journals 24. The front end of each of the upper arm segments 34 include a pair of plates 48 welded to the sides of the upper arm segments 34. The plates 48 each include a hole which corresponds to the journals 24 so that a pin 50 may be inserted through the holes in the plates 48 and the journal 24 for mounting the frame 32 to the mounting plate 16.

FIG. 4 is a rear view of the snowplow 10 in the lowered position. The snowplow 10 includes a height adjustment means so that the snowplow 10 can be mounted to pickups of various heights or pickups with lift kits. As shown in FIG. 4, the lower arm segments 38 include brackets 52 which are welded to the lower arm segments 38. The brackets 52 include four holes 54 arranged along its length. The brackets 52 are each bolted to an adjustable arm 56 which includes six holes along its length. The holes in the adjustable arm 56 and the bracket 52 can be aligned at various heights for use with different heights of pickups. This has the effect of shortening or lengthening the lower arm segments 38. In this way, the length of the frame 32 can be adjusted depending on which holes are used in bolting the adjustable arm 56 and the bracket 52 together. Of course any number of holes or spacing between holes could be used with the present invention. Also, different means could be used to attach the various components of the present invention together.

The adjustable arms 56 are rotatably mounted to the snowplow blade 58 via the mounting bolts 60. The blade 58 is rotatably mounted to the arms 56 so that when plowing, if the blade 58 strikes a solid object such as an embedded rock, a tree stump, a curb, etc., the blade 58 is allowed to rotate to prevent damage to the snowplow 10 or the pickup truck 14. FIG. 5 shows the snowplow 10 with the blade 58 rotated after hitting a solid object (dashed lines). A set of four springs 62 are used to bias the top of the blade 58 back to the position shown in solid lines. Each of the springs 62 is coupled at one end to the lower portion of one of the adjustable arms 56 and at the other end to the upper portion of the blade 58. As shown in FIG. 4, each adjustable arm 56 is connected to two of the springs 62. Preferably, the springs 62 are connected between the adjustable arms 56 and the blade 58 at the angles shown, although other angles could be used. The springs are connected to the blade 58 via an eye bolt 64 and an L-shaped bracket 66. The tension of the springs 62 can be adjusted by turning the nuts on the eye bolts 64.

The blade 58 is comprised of a curved blade plate 68 which is welded to a reinforcing frame structure including reinforcing end plate ribs 70 and upper and lower lateral frame members 72 and 74, respectively. Four additional reinforcing plate ribs 76 are located along the length of the blade 58 as shown in FIG. 4. The reinforcing plate ribs 70 and 76 give the blade 58 an increased strength. Preferably, the reinforcing plate ribs 70 and 76 are comprised of half inch steel. Bolted along the bottom of the blade 58 is a scraper 78 made from hardened steel. The total height of the blade 58 of the preferred embodiment is approximately 28 inches.

Figure 6:
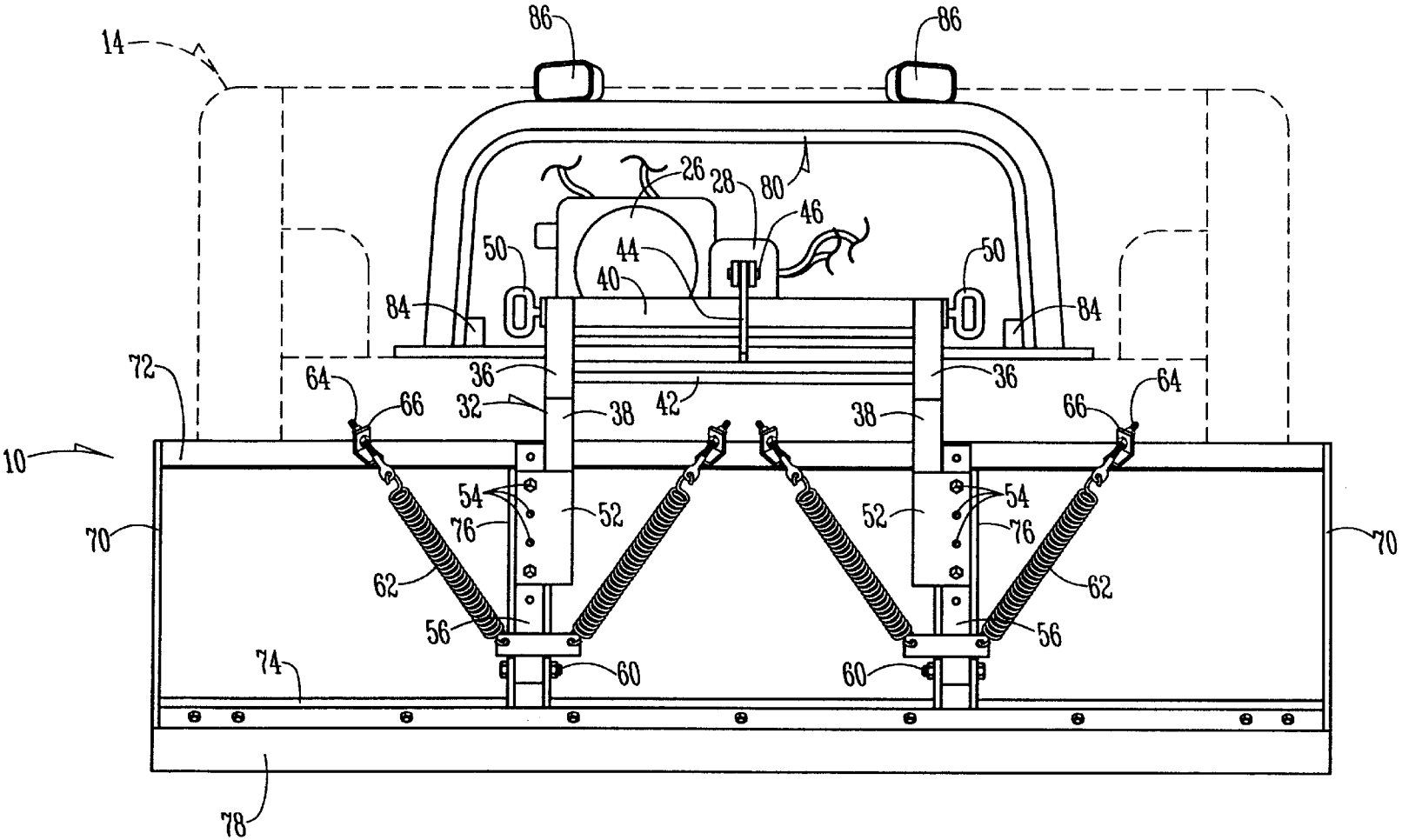
FIG. 6 is a rear view of the snowplow of the present invention including the power unit cowling.
Figure 7:
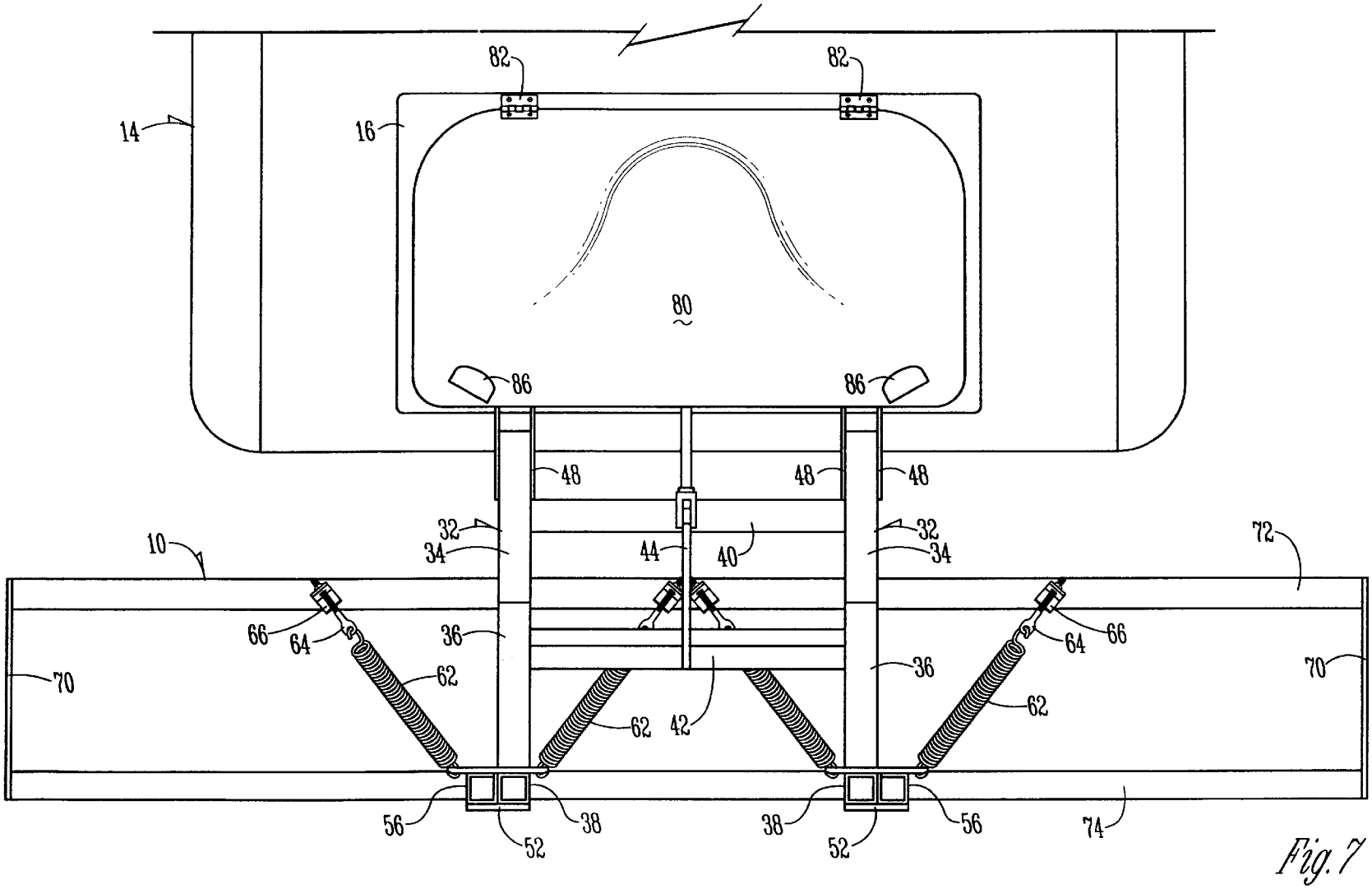
FIG. 7 is a top view of the power unit cowling shown in FIG. 6.

FIGS. 6 and 7 show an alternative embodiment of the present invention. FIG. 6 is a rear view of the snowplow 10 mounted to the pickup truck 14. FIG. 6 shows a fiberglass power unit cowling or cover 80 which covers the hydraulic power unit 26 and the hydraulic cylinder 28 to protect them from the elements. FIG. 7 is a top view of the cover 80. As shown, the cover 80 is hinged to the mounting plate 16 by hinges 82. The cover 80 is locked in place by conventional latches 84 shown in FIG. 6. By unlatching the latches 84 the cover 80 can be opened in case the user needs to get at the power unit 26 or the cylinder 28. FIGS. 6 and 7 also show optional flood lights 86 which increase the visibility for the user and others.

Figure 8:
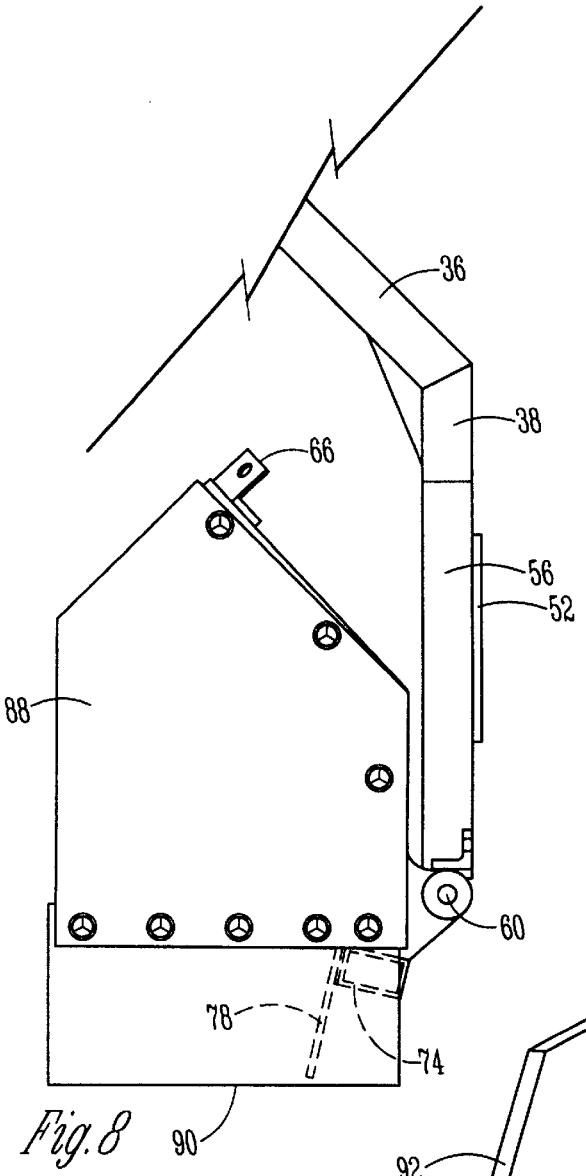
FIG. 8 is a side view of the snowplow of the present invention with a side wing installed.
Figure 9:
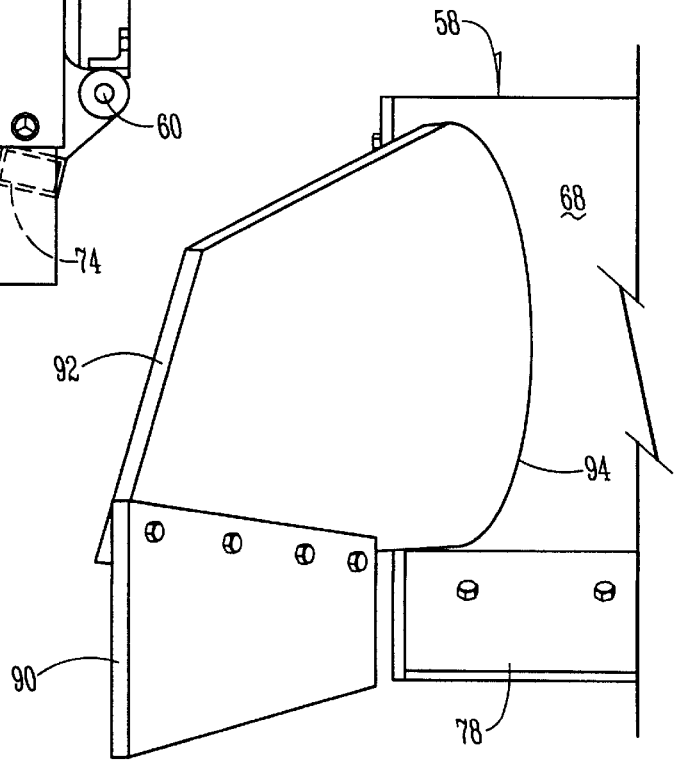
FIG. 9 is a side view of the snowplow of the present invention with an alternative side wing installed.

FIGS. 8 and 9 show further alternative embodiments of the present invention. FIGS. 8 and 9 show two styles of extension wings (or side wings) for use with the snowplow 10. The extension wings function to increase the volume of snow pushed by the snowplow 10 and increasing the width of the path cleared by the snowplow 10. FIG. 8 shows a box wing 88 which is comprised of a flat piece of steel bolted to the reinforcing end plate rib 70 at each end of the blade 58. The box wing 88 extends forward at a right angle relative to the blade 58. Bolted to the lower portion of the box wing 88 is a hard rubber flap 90 which is solid enough to move snow but will flex if the box wing 88 moves over a curb or other hard structure. FIG. 9 shows an angled wing 92 which is also bolted to the end plate rib 70. The angled wing 92 is comprised of a flat sheet of metal as well as a mounting plate (not shown) which corresponds to the end plate rib 70. The flat plate of the angled wing 92 has a curved edge 94 which is curved such that it matches the curve of the curved blade plate 68 when the angled wing 92 is mounted to the blade 58. The rubber flap 90 discussed above is also bolted to the angled wing 92.

Figure 10:
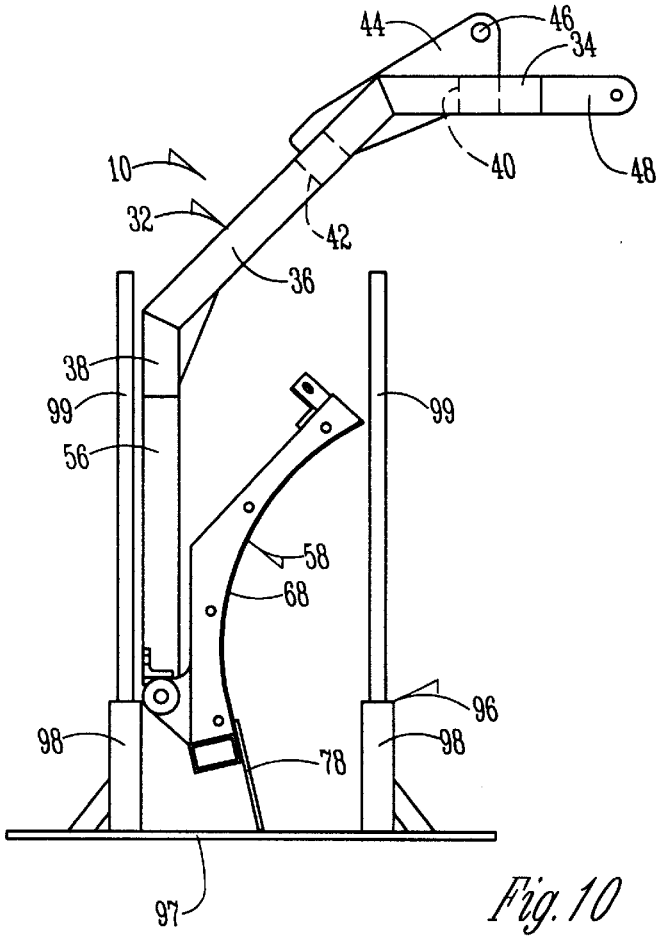
FIG. 10 is a side view of the snowplow and the storage stand of the present invention.
Figure 11:
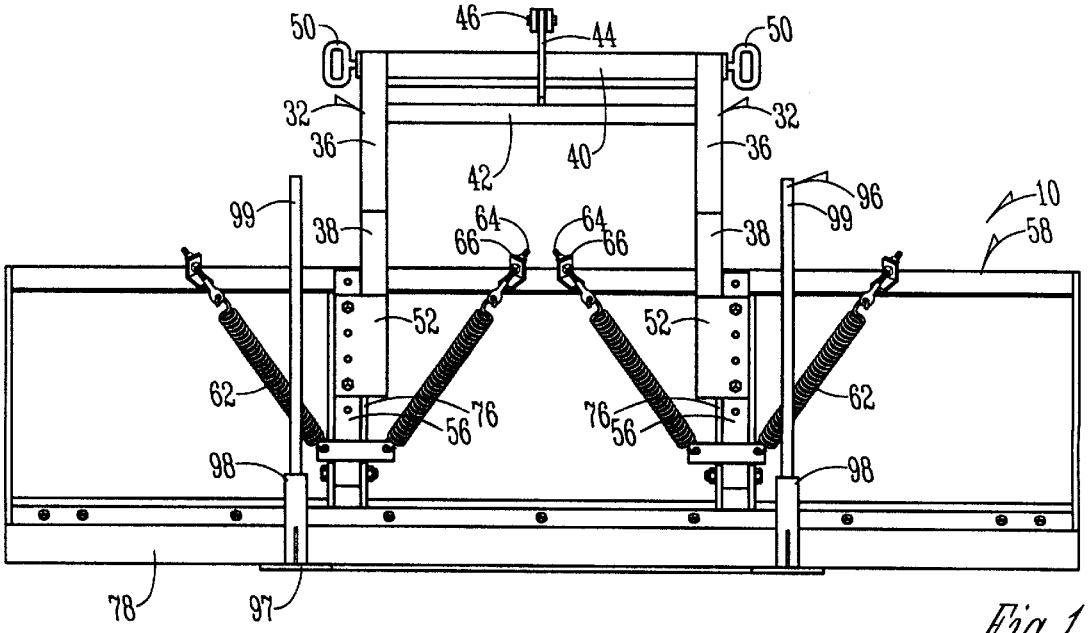
FIG. 11 is a rear view of the snowplow and the storage stand of the present invention.

FIGS. 10 and 11 show a further alternative embodiment of the present invention. FIGS. 10 and 11 show a stand 96 which is used to safely hold the snowplow 10 in an upright position when it is not mounted to the pickup truck 14. The stand 96 is comprised of a base 97 and four vertical tubes 98 adapted to receive the vertical pipes 99. To use the stand, the user positions the stand 96 where desired (without the pipes 99 inserted) and positions the snowplow 10 above the stand. The user then lowers the plow 10 to the position shown in FIG. 10. The pipes 99 can then be inserted into the tubes 98. The user then disconnects the plow 10 from the truck 14 by removing pins 50 and the pin connecting the hydraulic cylinder 28 to the cylinder bracket 44. The user can then move the pickup 14 and the snowplow 10 will remain in the position shown in FIGS. 10 and 11. The stand 96 makes installation and removal of the plow 10 simple as well as provides a safe method of storage of the plow 10.

The snowplow 10 is controlled by controlling the hydraulic cylinder 28. In the cab of the pickup truck 14 is a spring loaded toggle switch is biased to a middle position. To raise the snowplow 10, the user pushes the toggle switch in a first direction. To lower the snowplow 10, the user pushes the toggle switch in the opposite direction. When the user releases the toggle switch, it returns to the middle position and the snowplow 10 stays in the selected position until the user raises or lowers it again.

The present invention can include various other alternative embodiments. For example, the snowplow 10 does not have to mount onto a pickup truck bed. The snowplow 10 as shown could be mounted onto a flatbed truck, or on a wagon or trailer, for example. In addition, the snowplow 10 could be modified to mount onto the back of a sports utility vehicle. Of course, while the preferred embodiment of the present invention is intended for plowing snow, the present invention could easily be used as any other type of plow blade tool to level or move gravel, dirt, sand, or nearly any other material. The dimensions of the snowplow 10 can also vary within the scope of the present invention. A preferred width of the blade 58 is approximately 7 feet.

The snowplow 10 of the present invention operates as follows.

Before the initial use of the snowplow 10, the mounting plate 16 must be mounted to the bed 12 of the pickup 14. As described above, four L-shaped brackets are bolted to the sides of the pickup frame and the bolts 18 are inserted through the mounting plate 16, the anti-scuff mounting plate pad (if used), the bed 12, and are secured to the L-shaped brackets. The mounting plate 16 is therefore secured to the frame of the pickup 14. The remainder of the snowplow 10 is then attached to the mounting plate 16 by inserting pins 50 through the plates 48 which are attached to the frame 32 of the snowplow 10 (FIG. 2). The hydraulic cylinder 28 is connected to the mounting plate 16 at one end by pin 30 and to the frame 32 at the other end.

As described above, a control switch is located in the cab of the truck 14. The user can then control the snowplow 10 from within the cab of the truck 14. If desired, the tension of the springs 62 can be adjusted by tightening or loosening the eye bolts 64. Note that the snowplow 10 of the present invention can be used with or without a front mounted plow. By using the snowplow 10 in combination with the front mounted plow, the total plowing time can be cut significantly.

If the user is plowing under normal conditions, the snowplow 10 is lowered to the ground to the position shown in solid lines in FIG. 3. If desired, the user can apply a significant downward force if the user wants to more thoroughly scrape the ground surface. As the user drives the truck forward, the snow will be pushed and rolled by the curved surface of the blade 58. When the user wishes to turn around, or leave the snow in a pile, the blade 58 can be raised to the position shown in dashed lines in FIG. 3 or to any position in between. For cutting down large snow drifts, for example drifts against a garage door, the blade 58 can be raised (for example up to 48 inches) to the position shown by dashed lines in FIG. 3. The user can then back the truck 14 up to the drift and cut the drift by lowering the blade 58. This is not possible with a front mount plow or a prior art pull plow. In addition to cutting down large drifts, the truck 14 can be backed up to a garage door and the blade 58 lowered in front of the door to take nearly all the snow away from the garage.

When pushing snow with the snowplow 10, if a hard object such as a rock is encountered (FIG. 5) the blade 58 is allowed to rotate so that the snowplow 10 or truck 14 are not damaged. Once the blade 58 is past the object, the springs 62 will pull the blade 58 back to its normal position.

If desired, the user can also install the fiberglass power unit cowling 80 which is shown in FIGS. 6 and 7. If the user needs to access the hydraulic power unit 26 or the hydraulic cylinder 28, the latches 84 will allow the cover 80 to open about the hinges 82. The user may also install floodlights 86 on the cover 80. To increase the path width or to increase the volume of snow moved, the user may also choose to install side wings such as those shown in FIGS. 8 and 9. The snowplow 10 of the present invention can be easily removed from the truck 14 by removing the pins 50 (FIG. 2) and the pin attaching the hydraulic cylinder 28 to the cylinder bracket 44. The snowplow 10 can be stored by backing the plow over the stand 96 and lowering the plow to the position shown in FIG. 10 before removing the pins. The pipes 99 can then be inserted into the four tubes 98. The snowplow 10 will then be secured safely in the position shown in the figures.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A rear mounted snowplow adapted to be attached to an upper surface of the bed of a truck comprising:

a substantially horizontal mounting base adapted to be mounted within the bed of a truck above the upper surface of the bed;

a frame movably coupled to the mounting base;

a prime mover coupled to the frame for moving the frame relative to the bed of the truck; and a blade having opposite ends, the blade being coupled to the frame and being movable with the frame between a first position proximate a ground surface and a second position away from the ground surface, wherein the frame further comprises at least one leg assembly linking the blade and the mounting base, the at least one leg assembly being coupled to the blade at a position between and spaced apart from the opposite ends of the blade.

2. The snowplow of claim 1 wherein the frame has an adjustable height such that the height of the blade relative to the bed of the truck is adjustable for use with trucks of differing heights.

3. The snowplow of claim 1 wherein the blade is rotatably coupled to the frame.

4. The snowplow of claim 3 further comprising at least one spring coupled to the blade for biasing the position of the blade toward an upright position.

5. The snowplow of claim 4 wherein the at least one spring is connected between the blade and the frame at an angle.

6. The snowplow of claim 4 wherein the at least one spring is comprised of four separate springs.

7. The snowplow of claim 1 further comprising a cover for at least partially covering the prime mover and the mounting base.

8. The snowplow of claim 7 wherein the cover is hinged.

9. The snowplow of claim 7 wherein the cover is made from fiberglass.

10. The snowplow of claim 7 further comprising a light mounted to the cover.

11. The snowplow of claim 1 wherein the prime mover is comprised of a hydraulic cylinder.

12. The snowplow of claim 1 wherein the blade is an elongated blade having first and second ends, and further comprising at least one wing extension coupled to the first end of the elongated blade.

13. The snowplow of claim 1 further comprising a stand for holding the snowplow when it is not attached to the truck.

14. The snowplow of claim 13 wherein the stand further comprises:

a base; and a plurality of vertical rods for supporting the snowplow.

15. The snowplow of claim 14 wherein the vertical rods are detachable from the base of the stand.

16. The snowplow of claim 1, wherein the blade includes top and bottom edges and front and rear surfaces, the frame includes at least one arm extending from the mounting base, over the top edge of the blade, and behind the rear surface of the blade, and wherein the blade is coupled to the arm assembly at a point behind the rear surface of the blade and at a point between the top and bottom edges of the blade.

17. The snowplow of claim 16, wherein the blade includes an upper portion and a lower portion, and wherein the blade is coupled to the arm assembly in the proximity of the lower portion of the blade.

18. A method of mounting a snowplow to a truck comprising the steps of:

providing a truck having a substantially horizontal bed with an upward facing top surface;

providing a base;

mounting the base to the top surface of the bed of the truck;

attaching a frame to the base such that the frame is movable with respect to the bed;

coupling a prime mover to the frame for moving the frame relative to the bed; and coupling a snowplow blade having opposite ends to the frame such that the blade is movable with the frame between a first and second position, wherein the snowplow blade is coupled to the frame at a point located between and spaced inward from the opposite ends of the blade.

19. The method of claim 18 further comprising the step of moving the snowplow blade from the first position to the second position, wherein the snowplow blade contacts a ground surface while in the first position, and wherein the snowplow blade is higher than the base while in the second position.

20. The method of claim 18 further comprising the step of adjusting the length of the frame so that the height of the snowplow blade relative to the truck is adjusted to a desired height.

21. The method of claim 18, wherein the step of coupling the snowplow blade to the frame further comprises the steps of:

providing an arm assembly having which extends from the base, over and behind the blade, terminating at an end; and rotatably coupling the end of the arm assembly to the blade behind a rear surface of the blade.

* * * * *